United States Patent [19]

Jones

[11] 4,076,458

[45] Feb. 28, 1978

[54] AUTOMATIC PUMP SPEED CONTROLLER

[75] Inventor: Ray L. Jones, Costa Mesa, Calif.

[73] Assignee: Whittaker Corporation, Burbank, Calif.

[21] Appl. No.: 575,445

[22] Filed: May 7, 1975

[51] Int. Cl.[2] ..... F04B 49/08; F04B 49/00

[52] U.S. Cl. ..... 417/46; 417/63

[58] Field of Search ..... 417/12, 26, 28, 44, 417/46, 47, 52, 18, 63, 22, 4–8

[56] References Cited

U.S. PATENT DOCUMENTS

| | | | |
|---|---|---|---|
| 1,749,569 | 3/1930 | De Florez | 417/46 |
| 2,269,189 | 1/1942 | Downs | 417/22 |
| 3,005,411 | 10/1961 | Metz | 417/36 |
| 3,006,541 | 10/1961 | Bubb | 417/4 |
| 3,068,796 | 12/1962 | Pfluger et al. | 417/18 |
| 3,072,058 | 1/1963 | Christopher et al. | 417/47 |
| 3,072,060 | 1/1963 | Waite | 417/44 |
| 3,073,244 | 1/1963 | Elliot et al. | 417/43 |
| 3,225,542 | 12/1965 | Hanson et al. | 60/368 |
| 3,269,320 | 8/1966 | Tilley et al. | 417/53 |
| 3,572,959 | 3/1971 | Shaughnessy | 417/22 |
| 3,610,779 | 10/1971 | Hubby | 417/5 |
| 3,744,932 | 7/1973 | Prouett | 417/8 |
| 3,778,694 | 12/1973 | Hubby | 417/44 |
| 3,807,902 | 4/1974 | Grable | 417/46 |
| 3,817,658 | 6/1974 | Murase | 417/5 |
| 3,847,507 | 11/1974 | Sakiyama | 417/42 |
| 3,854,846 | 12/1974 | Douglas | 417/12 |
| 3,882,861 | 5/1975 | Kettering et al. | 417/44 |
| 3,932,067 | 1/1976 | Ball et al. | 417/339 |

*Primary Examiner*—William L. Freeh

*Attorney, Agent, or Firm*—Spensley, Horn & Lubitz

[57] ABSTRACT

An automatic pump speed controller for controlling and maintaining the strokes per minute of a down-hole oil well pump and providing signals on the surface indicating the actual strokes per minute of the pump. The automatic pump speed controller comprises a means for measuring the strokes per minute of the pump, and a means for adjusting the pump to correspond to a preselected stroke per minute value. The automatic pump speed controller also provides for a visual read out of the actual strokes per minute of the pump which enables an observer to obtain this information. In the present invention, pressure pulses from the pump are transmitted to the invented automatic pump controller on the surface and are monitored. If the pulses indicate that the pump is operating at a rate different than the preselected rate, the controller is adapted to automatically readjust the pump to conform to the preselected rate. Because the invented controller is ably to quickly and efficiency control the pump rate, the efficiency of the oil well is greatly increased.

28 Claims, 7 Drawing Figures

Fig. 1
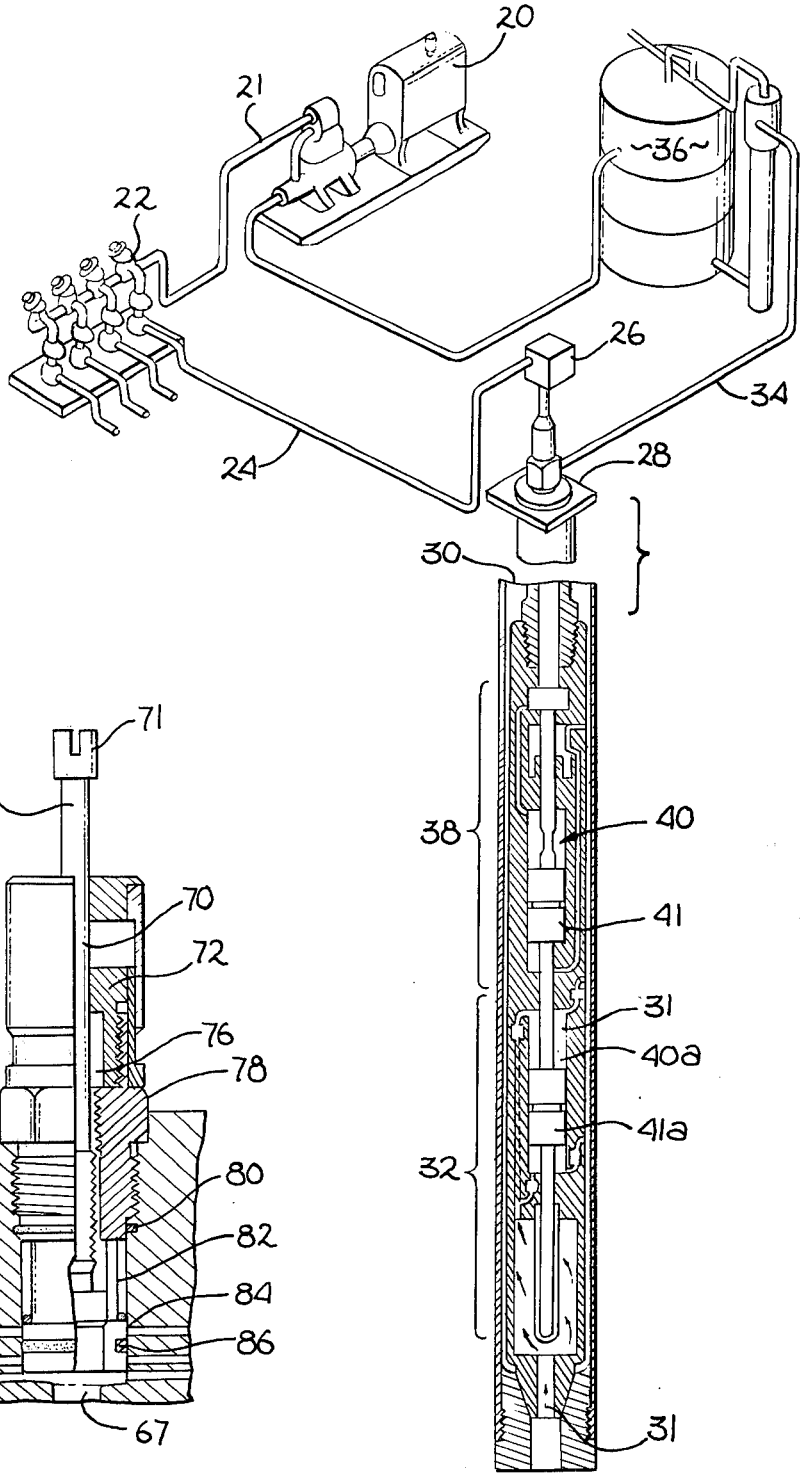
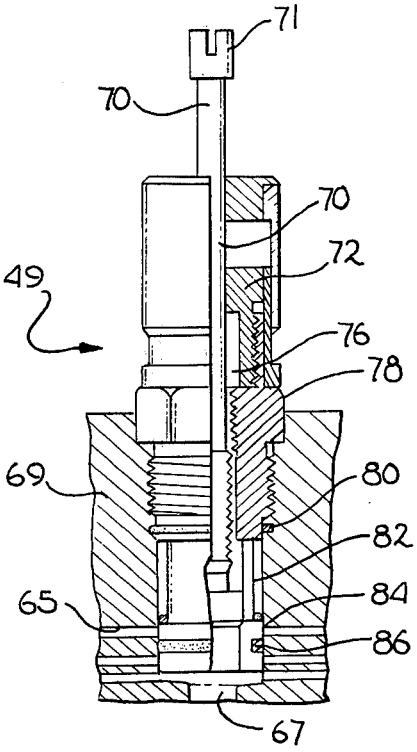
Fig. 4

AUTOMATIC PUMP SPEED CONTROLLER

BACKGROUND OF THE INVENTION

1. Field of the Invention

The present invention relates to the field of oil production via artificial lift methods, and more particularly, to a system of controlling the pumping rate of hydraulic oil well pumps.

2. Prior Art

A typical artifical lift oil well will have a pump located at a suitable depth in the well, often adjacent to the bottom thereof, to deliver oil through pipes within the well casing to the surface. These pumps are designed to operate beneath the oil level in the well and can be subject to rapid deterioration and premature failure if allowed to operate at an incorrect pump speed. Further, changes in the pump rate are a characteristic of nearly all present hydraulic oil well pump engines. Unfortunately, these changes are nearly always in the direction to reduce speed. It has been found that in a 24 hour period a decrease in the strokes per minute (and therefore the amount of oil) of 10–20% magnitude is not unusual. Failure of the pumps to maintain a predetermined rate results in direct and substantial loss of oil and revenue. The problem is especially acute today because of the great demand for oil. However any effort to compensate by setting a rate higher than desired can result in costly damage to the down-hole pump.

The prior art has attempted by varying techniques to control the pumping rates to maintain the highest level for efficiency, but they all contain a number of shortcomings. For example, Coberly et al, U.S. Pat. No. 1,957,320 disclose a device for controlling the pump rate depending upon the oil pressure in the well. This device uses a simple current sensing apparatus along with a solenoid to control the speed or rate of the pump. This type of device is not easily controlled and does not have a high overall accuracy. Another prior art system is disclosed by Grable et al, U.S. Pat. No. 3,807,902. The Grable et al system for changing the pump speed is based upon the level of a subsurface column of well fluid to be pumped. However, the Grable et al system is not concerned with modifying the pump rate because of the characteristic of hydraulic oil well pumps which causes them to reduce speed and the inefficiencies thus produced.

Another technique for determining pumping rate is to manually count, for one minute, the pressure pulses produced by each stroke of the typical down-hole reciprocating engine piston used in hydraulic oil well pumps, and reflected on the surface on a pressure gauge. This procedure is time consuming, tedious and inaccurate. Furthermore, human capability to effectively count pressure pulses decreases as the strokes per minute (hereinafter "SPM") of the pump increases. For example, it would be extremely difficult for a person to accurately determine a pump which had a rate of around 400 SPM. Consequently, severe errors in data can be expected under this technique.

In the past, after the pump rate was determined, the pump may have to be readjusted inasmuch as the actual pumping rate may be different than that desired. The problem of varying pump speed becomes quite acute when one realizes that hundreds, if not thousands of oil wells in an oil field may be operating under improper pump rates, that is, rates other than that desired by the user. Moreover, the hydraulic pumps presently used in oil well production may vary on a daily basis, thus it becomes necessary each day to check the rate in order to determine if the proper SPM is being used. In addition, any system which requires that the pump rate be manually modified when it is determined that the pump is not pumping at the desired rate, has this additional shortcoming.

Because of the present world wide shortage of oil and the skyrocketing demands, it becomes imperative for each oil well to maintain its highest level of efficiency in order to produce the greatest quantity of oil. Accordingly, any system which is utilized to control the pumping rate, should be automatic and must be able to readjust the rate for changes in the SPM without the need for continuous personal supervision within a relatively short period of time and with a high degree of accuracy.

BRIEF SUMMARY OF THE INVENTION

The oil well pump speed controller of the present invention comprises a means for sensing the pressure pulses produced by the "water - hammer effect" from the down-hole engine pistons. For example, the pressure pulses are measured by a pressure transducer in the pressure line adjacent to a pump valve on the ground surface. The transducer converts the pressure pulses produced by the water-hammer effect into electrical signals which are then sent to a signal processor. Transducers of this type are well known in the art. Unfortunately, present transducers are not capable in and of themselves of providing a sufficiently clear signal of the pressure pulses. Moreover, undesired signals due to the internal operation of the transducer or the down-hole engine cannot be eliminated by the transducer. Thus, there is a need for the signal processor. The signal processor represents one of the unique aspects of the present invention, and distinct improvement over the prior art. In the present invention the signal processor is adapted so as to filter the signal received from the transducer and select that signal which corresponds to the actual rate of the down-hole pump. The signal is then sent to a counter which counts the strokes for a one-minute period. The resulting total is strokes per minute (SPM) which appears on a digital display, which display of the total SPM is held for the succeeding minute while a new count is being taken. Concurrent with the above procedure, the count that is shown on the digital display is compared to a predetermined SPM that has been manually set by a digital switch. A "plus" differential from this comparison yields a signal pulse of corresponding polarity to a motor which powers a hydraulic valve to a new position necessary to increase or decrease the hydraulic power being delivered to the down-hole pump. Automatic and continuous changes are thus made in the valve setting until the SPM that is measured and the SPM that has been selected are the same.

It is therefore one object of the present invention to provide an automatic pump speed controller to increase oil production.

Another object of the present invention is to provide an automatic pump speed controller which is effective and reliable and which provides for a continuous monitoring of the pump speed of an oil well pump.

Yet another object of the present invention is to provide an automatic pump speed controller which modifies the pump speed of an oil well pump in a continuous manner until a preselected pump speed is reached.

It is yet another object of the present invention to provide a means to maintain relatively constant and efficient flow of oil by an automatic system.

The novel features which are believed to be characteristic of this invention, both as to its organization and method operation together with further objectives and advantages thereto, will be better understood from the following description considered in connection with accompanying drawings in which a presently preferred embodiment of the invention is illustrated by way of example. It is to be expressly understood however, that the drawings are for the purpose of illustration and description only and not intended as a definition of the limits of the invention.

BRIEF SUMMARY OF THE DRAWINGS

FIG. 1 is a view of a typical oil well installation with a hydraulic pump system including the pump speed controller of the present invention.

FIG. 4 is a cutaway view of the hydraulic valve used in the controller shown in FIG. 3.

DETAILED DESCRIPTION OF THE INVENTION

Figure 2:
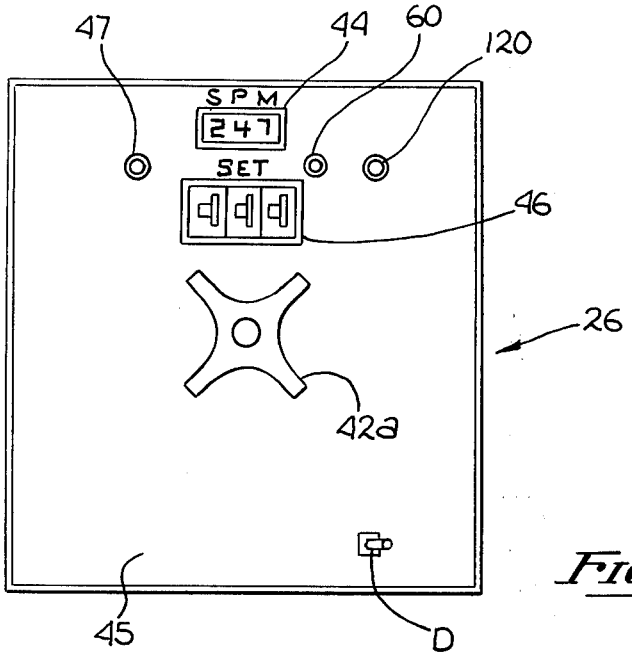
FIG. 2 is a front view of the automatic pump speed controller of the present invention.

Referring first to FIG. 1, a view of a typical oil well 30 incorporating the present invention may be seen. At the surface is a gasoline powered hydraulic power oil pump mechanism, generally indicated by the numeral 20. Mechanism 20 may be any of the well-known mechanism which can pump oil on a continuous basis to a down-hole hydraulic pump engine 38. Power oil 21 from the mechanism 20 is caused to flow through a valve means 22 which controls the flow to the various oil wells, For example, power oil 21 from mechanism 20 is caused to flow through pipe 24 to a pump controller 26 and then to a typical hydraulic pump engine 38 via pipe 27. Once in the engine cylinder chamber 40 of the hydraulic pump engine 38, the power oil 21 causes upper pistons 41 to reciprocate. Lower pistons **41*a* located in down-hole pump section 32 are coupled by a rod A to upper pistons 41 such that when upper pistons 41 reciprocate, so do lower pistons 41*a*. Lower pistons 41*a* cause the well oil 31 to be pumped out of the ground. Hydraulic pumps of this type are well known in the art. In the presently preferred embodiment the power oil 21 and the well oil 31 are mixed together and pumped through the well head 28 via pipe 34 to a storage tank 36. For example, power oil 21 flows into chamber 40 causing engine piston 41 to reciprocate up and down. Inasmush as engine piston 41 is coupled to pump piston 41*a*, the pump piston 41*a* also reciprates up and down. Crude well oil 31 inside of the pump cylinder 40*a* is thereby caused to be pumped to the surface of the well 30**.

In another embodiment, the power oil 21 is not mixed with the production oil 31; rather a separate piping system is provided for the power oil. In this embodiment, when the pistons 41 drive the power oil 21 out of the cylinder chamber 40, the power oil is sent to surface, generally to a power oil storage tank where it is again pumped by mechanism 20 to the down-hole engine 38.

In any embodiment however, it is apparent that the rate of the down-hole engine 38 is directly proportional to the rate of the down-hole pump section 32. Thus any variance in the engine rate produces a corresponding variance in the pump speed, and in the amount of oil pumped to the surface. One important aspect of such a pumping system, is the rate at which the hydraulic power means, usually power oil, is sent to the down-hole engine 38. By increasing the rate, the engine is caused to reciprocate faster, and correspondingly, by decreasing the rate, the engine is caused to reciprate slower. The present invention provides an automatic means to control the flow of the power oil 21 to the down-hole engine as hereinafter discussed. The action and mechanism of down-hole hydraulic oil well engines and pumps are well known in the art, and other hydraulic means may be used and are within the scope of the present invention. Moreover, other means of power than power oil 21 may be used to operate such down-hole pumps.

Figure 3:
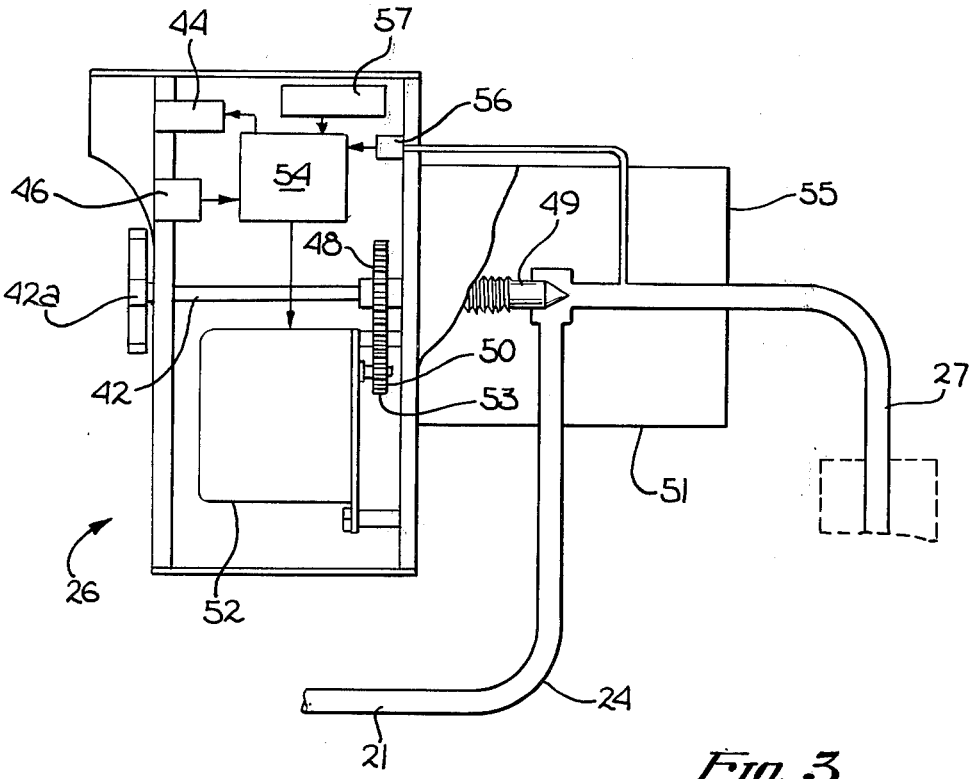
FIG. 3 is a partial cutaway view of the automatic pump speed control device as it connects to the well head.

Depicted in FIGS. 2 and 3 is the face and cut-away side view of the pump controller 27 of the present invention. In the presently preferred embodiment, the pump controller 26 is constructed so as be capable of withstanding the elements. The controller 26 has a front panel 45 on which some of the means for controlling the power oil 21 are mounted. In a usual installation, the power oil 21 flows into the controller 26 through the bottom 51, and out the back 55. A continuous digital read-out 44 is positioned on the front panel 45 of the pump controller generally near the top. The read-out 44, as more fully described hereinafter, is a series of light emitting diodes which indicate in strokes per minute the acutal pumping rate of the pump 32. Beneath the continuous digital read out 44 is the manual preset system 46. The manual preset system 46 consists of a series of rotatable dials such as thumb-switches which allow the user to select speeds from 0 through 999 strokes per minute. Thumbwheel switches of this type are well known in the art. Positioned near the center of the front of the pump controller is the manual override shaft 42 and corresponding handle **42*a*. This shaft allows the user to manually override and control the flow of oil through the pump controller by rotating the handle 42*a*. As previously discussed, by controlling the flow of oil through the pump controller, the SPM of the down hole hydraulic pump is regulated. By having the manual override one is able to effectively control the SPM of the down hole hydraulic pump 38 by hand should a failure in the automatic control system for the pump develop. On the left side of the front panel 45 of the controller 26 is the stroke inindicator 47. The stroke indicator 47 is generally a flashing light providing a visual indication that the controller is receiving a signal from the down hole pump 38. Other components, such as "on-off" switch "D" are also mounted on the front panel 45** for easy locating.

As indicated in FIG. 3, the manual override shaft 42 extends outward from a throttle valve 49 to the handle **42*a*. One can see in this figure that by causing the throttle valve 49 to close off the path through which the high pressure power oil 21 is flowing through the controller, shown as pipe 24, the amount of power oil from the gas-powered oil pump mechanism 20 that travels through the pipe 27 to the down hole hydraulic is thus controlled and may be completely prevented. The throttle valve 49** is a modified version of a well known throttle valve and will be more fully discussed hereinafter.

Because the pump speed controller 26 is most often adapted to an existing oil well and may be added as an additional component to the present means used to control the down-hole engine, the throttle valve 49 take on various constructions. For example, in a typical inline oil system the valve 49 would be a valve with low pressure drop, high volume characteristics. Such a valve is shown as valve 49 in FIG. 4. In another system, such as a "by-pass system", a different valve construction would be used. In the by-pass system the valve would have a high pressure drop, low volume characteristics. In such a system, a section of power oil pipe travels from pipe 24 (See FIG. 1) to the mechanism 20 by-passing the oil well 30. In this system, when the throttle valve is opened the power oil 21 is allowed to by-pass the oil well and flow back to mechanism 20. When the valve is closed, the power oil is prevented from taking this route and must now flow to the down-hole engine thereby activating the desired pumping action. As hereinbefore discussed, in an in-line system, opening the valve 49 causes the power oil to flow to the engine thereby activating the desired pumping action. Of course either of these embodiments may be adapted with the presently invented automatic pump speed controller by minor modification of the specific throttle valve utilized.

Inasmuch as most oil wells have in-line control systems for the down-hole engine, a typical throttle valve for such a system will now be discussed. Seen in FIG. 4 is the modified throttle valve of the present invention having a construction similar to that of the flow control valve assembly manufactured by Armco, Oilmaster Division, 9100 S. Norwalk Blvd., Los Nietos, California. Ser. No. 280,238. The valve 49 is adapted to be rotated by rotatable rod member 70. The rod member 70 has a grooved or hexagon end piece 71 which is ultimately coupled to a second rod member (not shown). This second rod is coupled to a motor as hereinafter discussed, and to motor shaft 53 (FIG. 2) such that as the shaft 53 of the motor rotates, the rod member 70 also rotates. Rotation of the throttle valve 49 caused the power oil 21 to flow through the openings 65 and out orifice 67 to the down-hole engine 38 of the oil well pump 32.

In the presently preferred embodiment such a throttle valve 49 in an in-line system is mounted in threaded member 69. Member 69 allows the valve 49 to be rotated therein so as to expose the desired number of holes 65 thus effectively regulating the flow of oil out of orifice 67. The valve 49 has a series of O-rings, shown as O-rings 80 and 86 in the presently preferred embodiment which form the sealing means to prevent power oil 21 from escaping out through the threaded member 69, but which allow the throttle valve 49 to be rotated therein. The O-ring 86 is disposed circumferentially about seat 84, and O-ring is disposed circumferentially about the area just above the sleeve section 82. The valve 49 also has a multi-faceted bonnet memnber 78 which permits the valve to be extracted by a tool which fits around the facets and unscrews the valve 49 from the member 69. A valve stem packing 76 is generally a teflon material, but other materials may also be used. The packing 76 is held in place by retainer 72. Thus, the various components of one typical throttle valve have been presented, however as pointed out, other valves are also within the scope of the invention.

In the typical operation of an oil well, such as well 30, there are shock waves which accompany each stroke of the lower pistons 41*a* of hydraulic pump 32. These waves travel pipe 27 to the transducer 56 which picks up the pulses. The transducer 56 is well known in the art and generally operates on the same principal as a pressure gauge. The transducer 56 changes the shock waves from changes in the pressure to electrical signals. The transducer 56 is coupled to the control electronic 54 hereinafter described such that the control electronics also receive the SPM in the form of electric signals. The control electronics 54 is coupled to the read out 44 which indicates the rate at which the hydraulic pump is operating in the form of strokes per minute. In the presently preferred embodiment, the control electronics 54 stores up the information received from the transducer 56 each minute and indicates the results on the digital read out 44 at the end of the one minute period. The read out, which indicates the SPM, does not change until a new valve has been counted in the control electronics which is different from that presently indicated.

Also coupled to the control electronics 54 is the manual preset dials 46 seen most clearly in FIG. 2. The manual pre-set dials 46 enable the user to input the desired SPM into the controller 26, and more specifically, the control electronics 54. The control electronics 54 compares the signal representative of the value selected by the manual preset 46 with that received from the transducer 56. Should a difference between the two values exist, for example, should the manual preset 46 be at a higher SPM than the actual SPM of the down hole hydraulic pump 32, the control electronics 54 generates a defference signal which activates a reversible gear head motor 52. The reversible gear head motor 52 causes a second gear means 50, disposed on the reversible gear head motor shaft 53 to revolve in one direction or the other depending on the signal received from the control electronics 54. Second gear means 50 engages the first gear means 48 disposed circumferentially on the shaft 42 of the throttle valve 49. Such motors are well known in the art. Thus, depending on which direction the gear means 50 rotates, the throttle valve 49 will open or close and thereby regulate the pumping rate of the down-hole pump 32.

Also shown in FIG. 3 is the optional computer interface 57. The optional computer interface allows the user to control the control electronics 54 as well as the manual preset 46 without the need to manually adjust the pump controller 26. For example, the computer interface 57 can be coupled to a transmitter means (not shown) which transmits the actual SPM to a receiving means. The user at the receiving means is now able to determine the SPM of the oil well. He may then select a desired SPM which is transmitted back to the optional computer interface 57 which in turn indicates to the control electronics 54 the desired SPM. Again, the control electronics 54 would compare the desired SPM with that received from the transducer 56 and would activate the means to control the throttle valve 49 should a faster or slower pump rate be indicated. This computer interface 57 allows one to centralize the controls for all the oil well pumps at one location, and eliminates the need to visit each well.

In another embodiment, the reversible gear head motor is replaced by two solenoids. One solenoid is adapted to open the valve 49, and one is adapted to close the valve. In this embodiment, a signal of a one polarity from the control electronics 54 would activate the solenoid which would cause the valve 49 to open and thus increase the SPM of the down-hole pump. A signal of the opposite polarity would close the valve and thus decrease the SPM of the down-hole pump.

Figure 5:
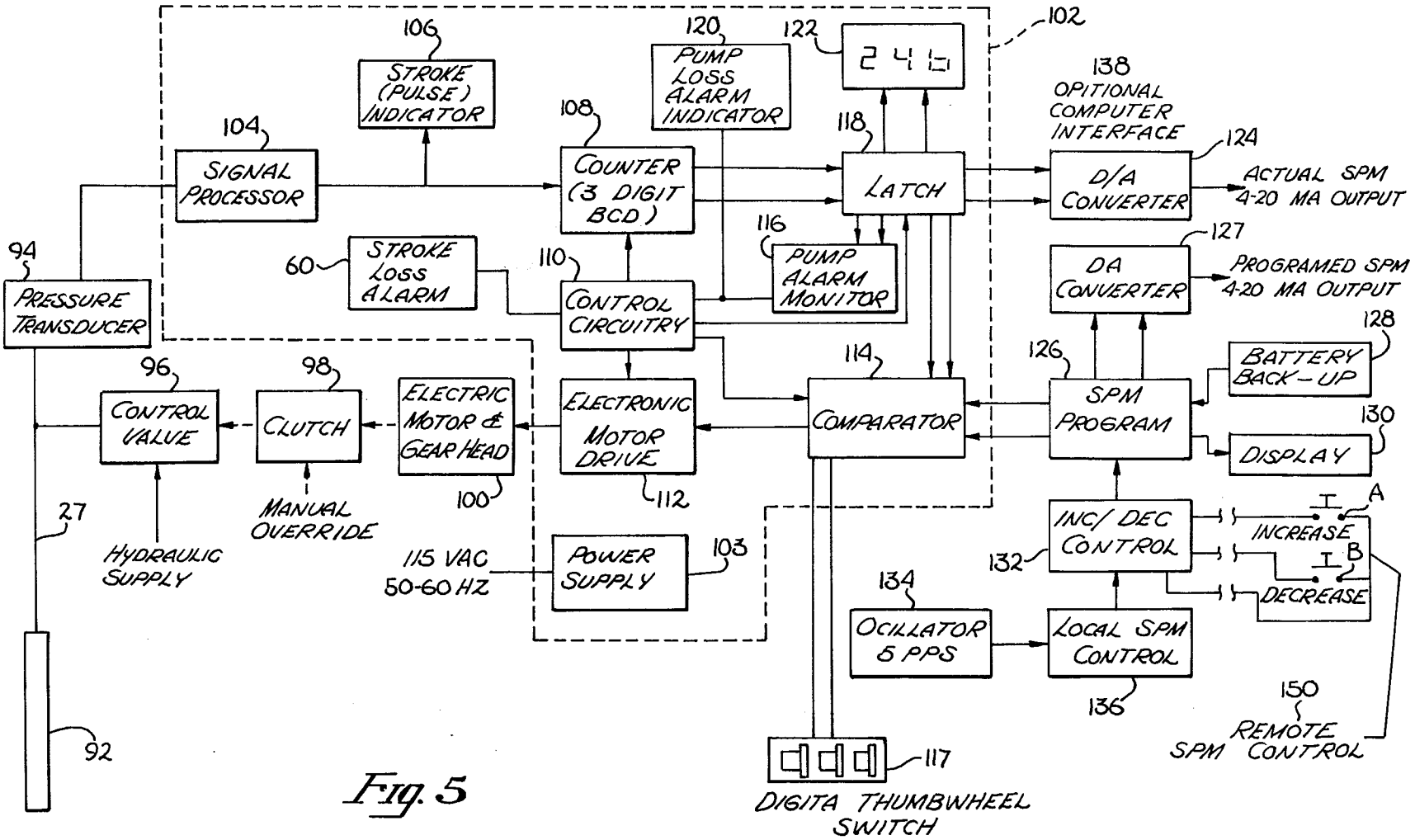
FIG. 5 is a block diagram of one embodiment of the electronics package and the optional computer interface of the present invention.

Referring now to FIG. 5, a block diagram of the pump speed controller is presented which shows the control electronics 102 and the optional computer interface 138. In the present preferred embodiment, the control electronics 102 is powered by power supply 103 which converts 115 volts of alternating current at 50/60 Hertz to a direct current for use by control electronics 102. In general, the information received from the pump 92 is picked up by the pressure transducer 94. This information is then transmitted to the control electronics 102. The down-hole hydraulic pump 92 is coupled to the pressure transducer 94 such that pressure changes in the form of impulses from the hydraulic pump are identified by the pressure transducer. In the presently preferred embodiment, the pressure transducer is comprised of a pressure gauge which notes changes in the pressure along the pipe 27. The pump pulsation are picked up by the pressure gauge in the pressure transducer 94 which converts the impulses to an electric signal. In the presently preferred embodiment, the pressure transducer is Model No. 205H2 manufactured by the Kistler Instrument Company, Overland Industrial Park, Redmond, Washington.

A signal processor 104 is coupled to the transducer 94 and receives the signal from the transducer. The signal processor 104 then modifies and selects the most accurate electrical signal such that the proper signal may be readily transmitted to the stroke indicator 106. The signal processor 104 represents one of the unique aspects of the present invention, and an advancement in the art of measuring devices. The problem with prior art signal processors is that they do not select the proper signal received from the transducer 94. In a typical situation, the signal from the transducer 94 is often times difficult to interpret. The signal is "garbled", in that it is a readily identifiable signal. By the use of the present signal processor 104, the signal received from the transducer 94 is broken down into frequency bands and the processor 104 selects that band corresponding most accurately to the actual pump speed of the down-hole pump 92. The signal processor 104 then sends that information to the stroke pulse indicator 106 and the counter 108.

The filters used in the signal processor 104 were designed based on an operating point determined through the use of a "Khron-Hite" adjustable filter. The "Khron-Hite" filter is composed of four active filter stages. The first two stages are high pass, while the second two stages are low pass and were originally suggested by R. E. Bach in "Selecting R-V Valves for Active Fillers," Electronucs 33 at pages 32–35 (May 13, 1960). The stroke indicator 106, also seen in FIG. 2 as the stroke indicator 39, is a flashing light which is located on the front panel of the controller. When a signal is received by the indicator 106 from the signal processor 104, it flashes thus indicating to the viewer in visual form the pumping action of the down-hole pump 92.

A gate counter 108, also coupled to the signal processor 106, counts up the strokes of the hydraulic pump in one minute intervals and transmits that information to latching circuit 118. Counter 108, in the presently preferred embodiment, is capable of recording from 0–999 strokes of the pump per minute. In the presently preferred embodiment, the counter counts square wave signal pulses, and at the end of one minute, it sends the count thus tallied to the latching circuit 118 so another count can be made. Latching circuit or latch 118 is a well known latching circuit design utilizing flip-flop circuitry and transmits a signal which is "remembered" by the latch 118 until additional information is received. Thus, at each one minute interval the latch 118 transmits the information it receives from the counter 108, to the comparator 114 and to the digital SPM rate indicator 122. The latch 118 continues to send this information until another signal, one minute later, is received. This other signal is now the one transmitted and remembered.

The rate indicator 122 is also shown in FIGS. 2 and 3 as the continuous digital read-out 44. The indicator 122 comprises a series of light emitting diodes (hereinafter LED) which gives a visual indication of the number of strokes per minute the control electronic 102 receives from the hydraulic pump 92. The comparator 114 which receives its signal from the latch 118, compares the SPM signal which the latch 118 has received from the gate counter 108, to the desired SPM rate received from the digital input thumbwheel switch assembly 117. Should there be a difference between the SPM supplied to the latch 118 and that supplied from the thumbwheel switch assembly 117, the comparator 114, which is also coupled to an electronic motor drive 112, activates the electronic motor drive 112. As hereinafter discussed, the motor drive 112 selectively opens and closes the control valve 96 thereby regulating the pump 92.

Figure 6A:
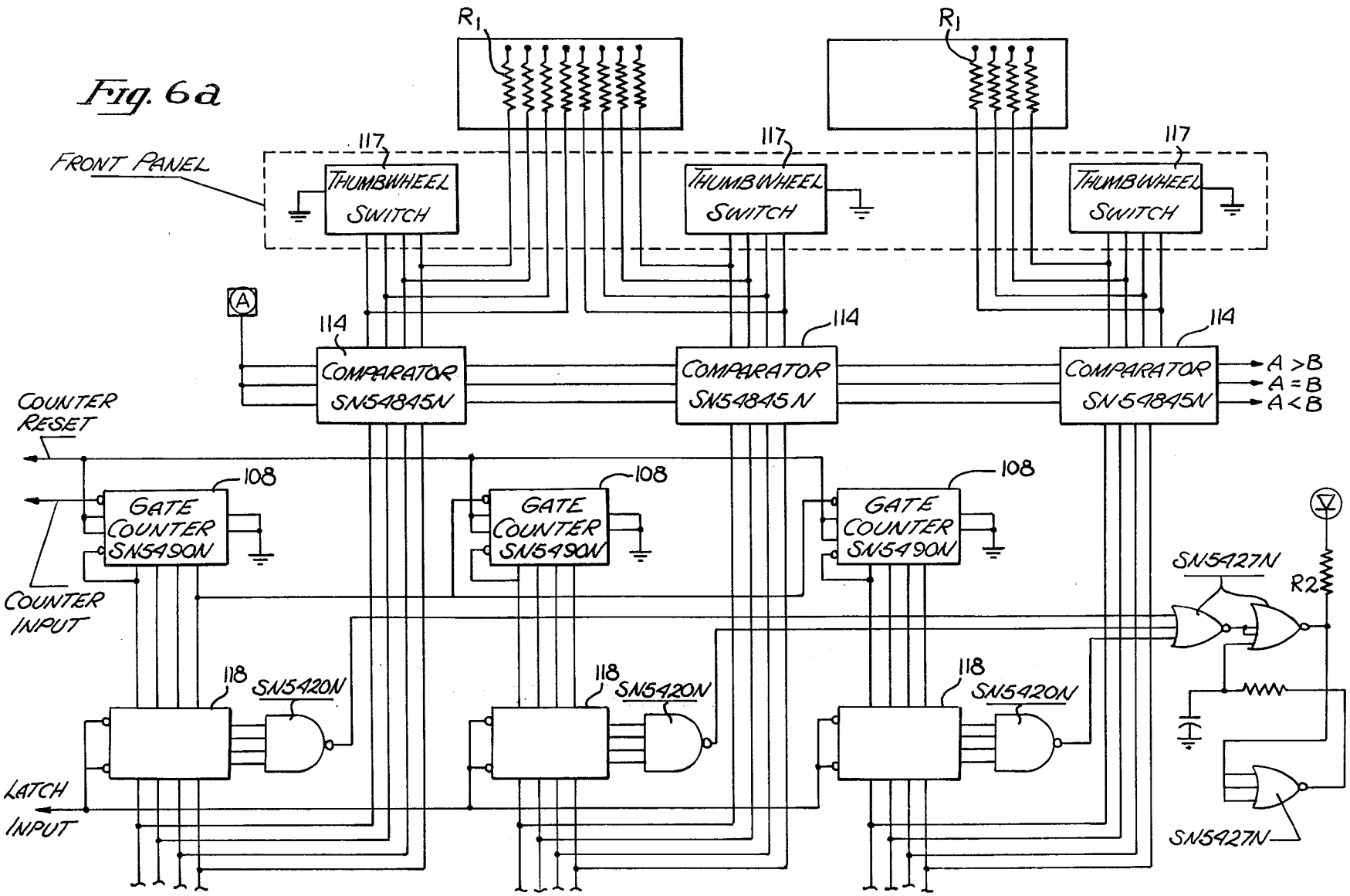
FIGS. 6A and 6B show one embodiment of the control circuitry used in the present invention to set the SPM and to compare the set SPM with the actual SPM of the down-hole pump.
Figure 6B:
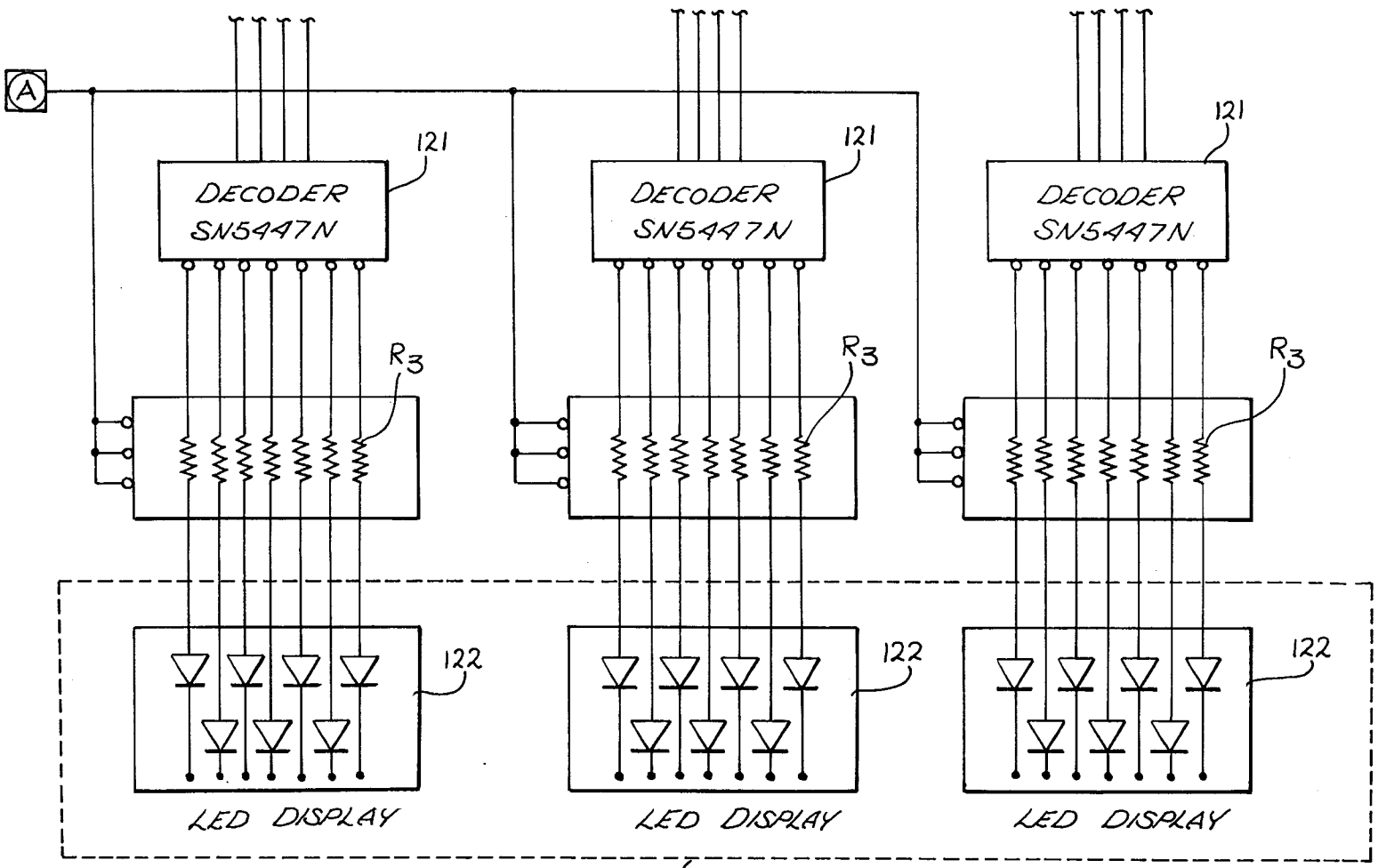

Reference to FIG. 6 shows some of the circuitry involved in the digital SPM rate indicator 122, the latching circuit 118, the gate counter 108, the comparator 114 and the digital thumbwheel switch assembly 117. In the usual situation, the desired SPM is put into the system by rotation of each thumbwheel switch 117. The information is then sent to the comparator 114. In the presently preferred embodiment comparator 114 is a 4-bit magnitude comparator for each of the 3 digits which sends one of the following messages to the electronic motor drive 112: "less than", "equal to", or "greater than". This signal is the result of a comparison between the information received from the thumbwheel switches 117 and that received from the latching circuit 118. The information transmitted by the latching circuit 118, as hereinbefore discussed, is the actual SPM of the down-hole pump 92. In the presently preferred embodiment, each latching circuit 118 is a 4-bit latch, with one chip making each of the three digit latches. Each latch functions as a flip-flop which stores data when it receives a store command. These type of latching circuits are well known in the art.

Coupled to the latch 118, and to the rate indicator 122 are three BCD to seven bar decoders 121. These decoders 121 convert the signal put out by the latching circuit 118 to a form which is receivable by the rate indicator 122. In the presently preferred embodiment rate indicator 122 is comprised of a series of LED displays which continuously indicate the SPM of the down-hole pump 92. Rate indicator 122 is also seen in FIG. 2 as the digital readout 44. Referring back to FIG. 6, various resistors are indicated generally by the letter "R". While the specific values would be apparent to one of skill in the art, in the preferred embodiment, $R_1=IK$ ohms, $R_2=220$ ohms and $R_3=68$ ohms. These resistors used to limit the current and/or voltage to each of the components so as to prevent possible overloading and shortouts.

When a difference does occur between the actual SPM of the down-hole pump 92, referring back to FIG. 5, and the predetermined rate, the electronic motor drive activates the electric motor and gear head 100 depending upon what signal is received by the drive 112 from the comparator 114. For example, the motor drive 112 will send an "increase" signal to the electric motor and gear head 100, if it receives a signal from the comparator 114 indicating that the pump 92 is operating at a rate less than the desired rate. If the comparator 114 sends a signal indicating that the pump rate is the same as the desired rate, the motor drive 112 will send no signal to the electric motor and gear head 100. As previously, discussed, the the motor and gear head 100 are coupled to the control valve 96 and cause the valve 96 to selectively rotate thereby regulating the flow of power oil pumped through pipe 27 to the down-hole engine of the hydraulic pump 92. Thus, the pump rate is maintained at the desired rate. However, should problems with the control electronics 102 develop, for example, should problems arise with the control circuitry 110, which controls various aspects of the counter, comparator, etc., a manual override clutch 98 is provided, also shown in FIGS. 2 and 3 of the manual override 42. The clutch 98 allows the user, notwithstanding the operation of the electric motor and gearhead 100, to open or close the control valve 96 and thus regulate the SPM of the down-hole pump 92. There is also provided, a pump loss alarm monitor 116 which controls an indicator 120 and may control a bell, buzzer, and the like, to indicate any failure in the system which inhibits operation of the pump. Another failure indication provided is a stroke loss alarm 60 which indicates that a system failure or condition occurs which prohibits the predetermined SPM from being maintained even though the throttle valve has been opened to its full open position.

An optional computer interface 138 as indicated in FIG. 5 may also be coupled to the control electronics 102. The computer interface 138 enables one to efficiently determine and adjust the SPM of a down-hole pump, such as pump 92, without the need to actually go to well head and the pump controller 26. In this embodiment a computer interface would be disposed inside the pump controller 26, shown as computer interface 57 in FIG. 3. The computer interface 138 of FIG. 5 is coupled to a remote SPM control means 150 for receiving signals from the interface and for controlling the down-hole pump 92. The control means is generally located at a computer terminal, and the like.

In the presently preferred embodiment, the computer interface 138 comprises a digital to analog converter 124 which is coupled to the latch 118. The digital to analog converter takes the signal from the latch 118 and converts it into a form which can be transmitted to the remote control 150. In the presently preferred embodiment, the converter 124 has an output of 4 – 20 ma. Thus, the converter 124 outputs the same information as that stored in the latching circuit 118. And the actual SPM of the pump is now received at the computer terminal where the remote SPM control 150 is located.

An SPM program register counter 126 is coupled to the comparator 114. The counter 126 inputs the signal it receives from the remote control 150 to the comparator 114. The signal from the remote control 150 is the desired SPM. In the preferred embodiment there is also a visual display 130 of the desired SPM as it is received by the counter 126. This enables one at the well head to see what pump rate is being sent to the pump from the remote control 150. The counter 126 is also coupled to a digital analog converter 127 having an output of 4 – 20 ma. A battery back-up 128 is provided for the counter 126 should a failure develop in the electrical system. The converter 127 transmits the programmed SPM back to the remote control 150 at the computer terminal. The signal is sent back to the control 150 so as to provide a means to check that the computer interface 138 has received the desired signal, and that the signal has been inputted into the comparator 114.

The remote SPM control 150 generally two switches A and B coupled to an increase/decrease controller 132. The controller 132 is located in the interface 138. These switches permit one to vary the SPM of the pump, and even to completely stop the pump from the location of the remote control 150.

Another optional feature of the present invention is local SPM control 136 and oscillator 134. The local SPM control 136 may also be used in lieu of or in addition to thumbwheel switch 117. This control 136 is generally disposed on the pump controller 26 itself and operates in the same manner as the switches A and B at the remote control 150. When it is desirable to adjust the down-hole pump, the oscillator 134 is activated, for example it is depressed, which causes the local SPM control 136 to send a decrease or increase signal to the increase/decrease controller 132 at a rate of 5 SPM each second while the local control 136 is activated. This system enables one to change the SPM quickly without the need for manually twisting the throttle valve, or rotating dials of the thumbwheel switch assembly 117. The information input into the local control 136 is sent to the control electronic 102 inasmuch as the control 136 is coupled to the increase/decrease control 132 and SPM program counter 126 which, in turn, is coupled to the comparator 114. In this embodiment one is able to quickly and easily activate the down-hole pump 92 and therefore has particular applicability when starting up the pump 92.

By the use of the described computer interface 138 and the remote SPM control 150, one is able to determine the actual SPM via converter 124. The internal workings of the control electronic 102 remain the same. This means that should an increase or decrease in the SPM of the pump 92 occur, the control electronic 102 would correct for it by opening or closing the control valve 96. These changes in the pumping rate of the pump 92 are then monitored at the remote SPM control 150 via converter 124 and provide one with the benefit of this information. Moreover, the increase and decrease switches, A and B respectively allow one to provide the desired SPM into the control electronic 102 with much the same effect as the thumbwheel switch 117. However, the switches A and B are generally located a distance from the actual well, thus providing one the advantage of not having to check each pump. In addition, by providing a number of wells with the computer interface 138, one local remote SPM control may be establish which would both monitor and control all the wells.

It is easily seen that by use of the hereinbefore described pump controller with or without the computer interface 138, provides a number of novel and unexpected advantages when compared to the pump controllers of the prior art. For example, by combining the functions of a transducer with a signal processor, a most accurate means of determining and transmitting a signal corresponding to the actual rate of an oil well pump is achieved. And by coupling a throttle valve to a motor, which is activated when a difference between the desired SPM and actual SPM exists, the invented pump speed controller is rendered substantially automatic. Moreover, the means used for comparing the desired SPM with the actual SPM as hereinbefore discussed, prevents substantial errors which has plagued the prior art. Finally, the optional computer interface allows one to control and monitor one or several oil wells from one central location.

While this invention has been disclosed and described with specific embodiments, the principles involved are susceptible of other applications which will be apparent to persons skilled in the art. This invention, therefore, is not intended to be limited to the particular embodiments herein disclosed.

I claim:

1. Apparatus for pumping oil from an oil well comprising:

(a) a reciprocating piston hydraulic pump located down the bore hole of the oil well remote from the surface;

(b) means for operating said hydraulic pump for causing said pump to reciprocate to pump oil from said down hole location remote from the surface, said pump generating pressure pulses with each stroke of the piston of said pump, which pressure pulses travel from the pump to the surface;

(c) means located at the surface of said oil well for sensing the said pressure pulses generated by said remotely located down hole reciprocating piston hydraulic pump, and for generating a signal representative of the rate of the pressure pulses sensed per unit of time and thereby of the speed in strokes per unit time of said remotely located down hole reciprocating piston pump;

(d) input means for enabling the selection of a predetermined pumping rate for said pump and for generating a signal representative of the said selected pumping rate in strokes per unit time;

(e) comparator means coupled to said input means and to said signal generating means for comparing said selected pumping rate signal with said actual pumping rate signal and for generating a difference signal representative of the difference between the actual and selected pumping rates; and (f) means for adjusting said pumping rate of said pump, said means for adjusting said pumping rate being coupled to said pump and to said comparator means such that when said actual pumping rate differs from said predetermined pumping rate, said means for adjusting said pumping rate is activated and causes said pump to conform to said predetermined rate.

2. The apparatus as defined in claim 1 wherein said means for adjusting said pumping rate comprises a throttle valve.

3. The apparatus as defined in claim 1 wherein, in addition thereto, a computer interface is coupled to said controller, said computer interface adapted to control and monitor said hydraulic pump controller from a remote location.

4. The apparatus as defined in claim 1 wherein said means for sensing said pressure pulses comprises a transducer, said transducer being adapted to convert said pressure pulses received from said pump into electric signals representative of said actual pumping rate of said pump.

5. The apparatus as defined in claim 1 wherein said input means for selecting a predetermined pumping rate is a variable switch, said variable switch being adapted to be set at any of a number of predetermined positions, each said position corresponding to a different pumping rate.

6. The apparatus of claim 5 where said variable switch is a series of digital input thumbwheel switches.

7. The apparatus as defined in claim 1 wherein said hydraulic pump is powered by a flow of power oil, said flow of power oil being adjusted by said means for adjusting said pumping rate.

8. The apparatus as defined in claim 7 wherein said means for adjusting said pumping rate is a throttle valve;

9. The apparatus as defined in claim 1 wherein said controller comprises in addition thereto, a signal processor, said signal processor adpated to receive signals from said pump and to select that signal which corresponds approximately to the actual pumping rate of said pump.

10. The apparatus as defined in claim 9 wherein said signal processor is coupled to said means for measuring said actual pressure pulses.

11. The apparatus as defined in claim 10 wherein said means for measuring said pressure pulses is a transducer, said transducer is adapted to convert said pressure pulses received from said pump into electrical signals whereby said electrical signals are transmitted to said signal processor.

12. The apparatus as defined in claim 1 wherein in addition thereto, a visual indicator for indicating the pump speed of said pump is provided, said visual indicator is coupled to said comparator means, said indicator being adapted to indicate the actual pumping rate of said pump.

13. The apparatus as defined in claim 12 wherein said visual indicator is a series of light-emitting diodes.

14. A pump controller coupled to a down-hole oil well reciprocating piston hydraulic pump, said hydraulic pump creating a pressure pulse for each stroke of said pump, the rate of said pressure pulses corresponding to the pumping rate, which pressure pulses travel up the said well to the surface, said controller comprising:

a transducer coupled to said pump for sensing said pressure pulses of said pump in strokes per unit time and for converting said sensed pulses into an electric signal representative of said rate of said pulses and thus of said actual pumping rate;

(b) input means for enabling the selection of a predetermined pumping rate of said pump and for generating a signal representative of the said selected pumping rate in strokes per unit time;

(c) a signal processor, said signal processor coupled to said transducer, said signal processor adapted to receive siad signals from said transducer and to produce an output signal representative of the actual pumping rate of said pump;

(d) comparator means for comparing said predetermined pumping rate signal with said actual pumping rate signal, said comparator means coupled to said transducer and to said signal processor and generating a difference signal; and (e) means for adjusting said pumping rate being coupled to said pump and to said comparator means to receive said difference signal such that when said actual pumping rate differs from said predetermined pumping rate, said means for adjusting said pumping rate is activated and causes said pump to conform to said predetermined rate.

15. The controller as defined in claim 14 wherein said input means comprises a variable switch, said variable switch being adapted to be set at any of a number of predetermined positions, each said position corresponding to a different pumping rate.

16. The controller as defined in claim 15 wherein said variable switch varies from 0–999 strokes per minute.

17. The controller as defined in claim 14 wherein, in addition thereto, a means for transmitting said pumping rate to a receiving location is coupled to said controller.

18. The controller as defined in claim 17 wherein said transmitting means is adapted to vary said pumping rate of said down-hole hydraulic pump.

19. A pump controller for controlling and measuring the pump rate of a down-hole reciprocating piston hydraulic pump, said hydraulic pump creating a pressure pulse for each stroke of said pump corresponding to the pumping rate which pressure pulse then travels up the said well to the surface, said controller comprising:

(a) a transducer coupled to said pump for sensing said pressure pulses of said pump in strokes per unit time, said transducer adapted to convert said pressure pulses into electric signals representative of said actual pumping rate;

(b) input means for enabling the selection of a desired pumping rate for said pump and for generating a signal representative of the said selected pumping rate in strokes per unit time, said input means being adapted to be set at a number of predetermined positions, each said position corresponding to a different pumping rate;

(c) a signal processor, said signal processor coupled to said transducer, said signal processor adapted to receive and filter said electric signal from said transducer and to produce an output signal which corresponds to the actual pumping rate of said pump;

(d) counting means, said counting means coupled to said signal processor, said counting means being adapted to receive said output signal from said signal processor which corresponds to said actual pumping rate of said pump, said counting means counting each said signal for a selected period of time to determine said measured pumping rate of said pump;

(e) comparator means for comparing said predetermined pumping rate with said actual pumping rate, said comparator means coupled to said transducer and to said counting means; and (f) means for adjusting said pumping rate of said pump, said means for adjusting said pumping rate coupled to said pump and to said comparator means such that when said actual pumping rate differs from said predetermined pumping rate, said means for adjusting said pump rate is activated and causes said pump to conform to said selected rate.

20. The controller as defined in claim 19 wherein said means for adjusting said pumping rate of said pump comprises a motor and throttle valve, said motor coupled to said comparator and to said throttle valve, said motor being adapted to selectively open or close said throttle valve when said measured pumping rate differs from said predetermined pumping rate.

21. The controller as defined in claim 19 wherein in addition thereto, a visual indicator for indicating the pump speed of said pump is provided, said visual indicator is coupled to said comparator means, said indicator being adapted to indicate the actual pumping rate of said pump.

22. The controller as defined in claim 21 wherein said visual indicator is a series of light-emitting diodes.

23. The controller as defined in claim 19 wherein, in addition thereto, a means for transmitting said pumping rate to a receiving location is coupled to said controller.

24. The controller as defined in claim 23 wherein said transmitting means is adapted to vary said pumping rate of said downhole hydraulic pump.

25. In an oil well field having at least one oil well having a down-hole well reciprocating piston hydraulic pump, said hydraulic pump creating a pressure pulse for each stroke of said pump corresponding to the actual pumping rate which then travels up said well to the surface, the improvement which comprises a pump controller for controlling the pumping rate of said pump, said controller comprising:

(a) means for sensing said pressure pulses of said pump in strokes per unit time and for generating a signal representative of said actual pumping rate;

(b) input means for enabling the selection of a predetermined pumping rate of said pump and for generating a signal representative of the said selected pumping rate in strokes per unit time;

(c) comparator means for comparing said selected pumping rate signal with said actual pumping rate signal, said comparator means coupled to said input means and to said means for generating said actual pumping rate signal and generating a difference signal; and (d) means for adjusting said pumping rate of said pump, said means for adjusting said pumping rate being coupled to said comparator means to receive said difference signal such that when said actual pumping rate differs from said predetermined pumping rate, said means for adjusting said pumping rate is activated and causes said pump to conform to said predetermined rate.

26. The oil well field as defined in claim 25 wherein said means for adjusting said pumping rate is a throttle valve.

27. The oil well field as defined in claim 25 wherein said controller further comprises a signal processor, said signal processor coupled to said sensing and generating means and processing that signal which corresponds approximately to the actual pumping rate of said pump.

28. The oil well field as defined in claim 25 wherein there are a plurality of oil wells each having a controller coupled thereto.

* * * * *